United States Patent [19]

Yeates et al.

[11] Patent Number: 4,929,132

[45] Date of Patent: May 29, 1990

[54] ARTICULATED PLATFORM CAR FOR THREE OR FOUR TRAILERS

[75] Inventors: Richard P. Yeates; Bruce E. Keating, both of Aurora, Ill.; William R. Halliar, Whiting, Ind.

[73] Assignee: Trailer Train Company, Chicago, Ill.

[21] Appl. No.: 294,363

[22] Filed: Jan. 9, 1989

[51] Int. Cl.[5] ..... B61D 3/18; B61D 47/00

[52] U.S. Cl. ..... 410/56; 410/54; 410/45; 410/57

[58] Field of Search ..... 410/53, 54, 44, 45, 410/56, 57, 52, 1, 67, 58

[56] References Cited

U.S. PATENT DOCUMENTS

| | | | |
|---|---|---|---|
| 2,851,963 | 9/1958 | Sheehan | 410/65 |
| 2,960,043 | 11/1960 | Clesan | 410/54 |
| 4,671,714 | 6/1987 | Bennett | 410/1 |

*Primary Examiner*—Andres Kashnikow
*Assistant Examiner*—Mark T. Le
*Attorney, Agent, or Firm*—Kinzer, Plyer, Dorn, McEachran & Jambor

[57] ABSTRACT

An articulated railroad flat car for transporting four short or three long semi-trailers comprises two units connected by a drawbar. A plurality of semi-trailer hitches are mounted on the units. The hitches are suitably spaced for securing either three long trailers or four standard trailers, using overhead loading or circus loading. When three long trailers are loaded, the middle trailer is attached to a hitch on one of the units and has its tandem resting on the other unit. The unit on which the tandem rests has a widened floor section at its end adjacent the drawbar to accommodate turning or skewing of the tandem when the car negotiates a curve.

16 Claims, 3 Drawing Sheets

ARTICULATED PLATFORM CAR FOR THREE OR FOUR TRAILERS

BACKGROUND OF THE INVENTION

This invention relates to railroad flat cars of the type used to transport semi-trailers in what is commonly referred to as piggyback service. One of the difficulties faced by railroads providing piggyback service is matching the railroad car fleet to the various sizes of trailers encountered. Economical operation requires maximum flexibility in car loading without wasting car space. Thus, it is desirable to arrange the car so that trailers of various sizes can be accommodated.

To illustrate the problem, in the past it has been common to carry two 45-foot trailers on one 90-foot car. Somewhat shorter trailers could also be accommodated, two on a car. However, trailers longer than 45 feet are now being utilized. For example, 57-foot trailers are now in service. Obviously, two 57-foot trailers cannot be loaded on a single 90-foot car. Loading one such trailer on a car leaves approximately one-third of the car's length unused. In effect, then, for every three 57-foot trailers loaded one-on-one on 90-foot cars, the space equivalent of one complete car is wasted.

SUMMARY OF THE INVENTION

The present invention overcomes the difficulties described above by providing an articulated flat car having at least two platforms or units for transporting trailers. The dual-platform version of the car can accommodate four standard trailers or three long trailers. Four standard trailers are accommodated in the usual arrangement with two trailers on each unit of the car. Alternately, three long trailers are accommodated, one trailer on each unit with a third trailer spanning the two units.

The car of the present invention includes a plurality of collapsible trailer hitches for mounting trailers on units in either the four-on-two or three-on-two configuration. There are two end hitches located near the outer of the ends of the car, i.e., at the coupler ends of the two units. There are also two central hitches mounted intermediate the ends of the units, one approximately in the center of each unit. A span hitch is mounted on one of the units between the drawbar and central hitch. It is located so as to secure a trailer which spans the drawbar. In an alternate embodiment, the hitches may be arranged so as to allow for circus loading of the car. This embodiment requires repositioning one of the end hitches to place it adjacent the drawbar, turning a central hitch around and provision of an auxiliary hitch.

The unit supporting the tandem or wheel set of the spanning trailer has a widened floor or deck portion at its end adjacent the connected unit. The width of the widened floor portion is greater than the remainder of the car. The widened floor portion accommodates turning or skewing of the tandem when the car negotiates a curve.

BRIEF DESCRIPTION OF THE DRAWINGS

FIG. 5 shows three circus-loaded long trailers, while FIG. 6 shows four circus-loaded standard trailers.

DETAILED DESCRIPTION OF THE INVENTION

Figure 1:
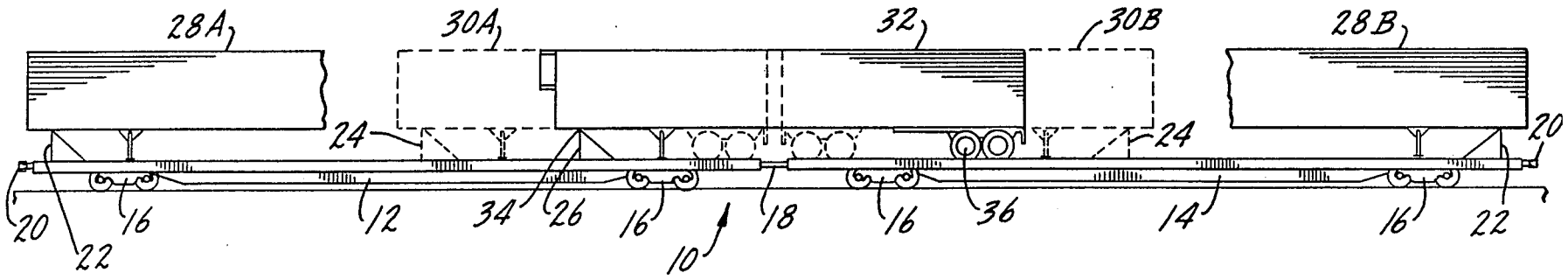
FIG. 1 is a side elevation view of the car, showing the alternate possibilities for loading trailers.

The railroad flat car of the present invention is shown generally at 10 in FIG. 1. In one embodiment the car includes two units or platforms, designated an A unit 12 and a B unit 14, supported on trucks 16 and connected by a rigid drawbar 18. The outer ends of the units carry conventional couplers 20. For reference purposes, the length of the units may be about 90 feet over strikers and the drawbar length may be about 90 inches. The construction of the drawbar is conventional and may be as shown in U.S. Pat. No. 4,545,304, the disclosure of which is incorporated herein by reference.

Each unit 12, 14 includes an underframe formed by a center sill, bolsters, cross-braces and cross-ties. A floor or deck is attached to this frame structure. Further details of the underframe will be described below.

The units 12, 14 support a plurality of trailer hitches which are shown diagrammatically in FIG. 1. There are two end hitches 22 at the coupler ends of the car. Central hitches 24 are mounted intermediate the coupler end and the drawbar end of each platform. A span hitch 26 is mounted on the A unit 12 between the central hitch 24 and the drawbar end of the unit 12. The central hitches 24 and the span hitch 26 must be collapsible to accommodate loading of various size trailers.

The placement of the hitches 22, 24 and 26 is such that they can mount various size trailers, as illustrated in FIG. 1. For example, four 45-foot trailers could be loaded on the car. These would include outer trailers 28A and 28B secured to hitches 22 on each platform. The length of the outer trailers 28 is such that two inner trailers 30A and 30B, shown in phantom, will fit in between the outer trailers. The inner trailers 30 are fastened to central hitches 24 on each platform.

Alternatively, the inner trailers 30A and 30B could be replaced by a single 57-foot trailer 32 having a king pin 34 connected to the span hitch 26 on A unit 12 and a tandem or wheel set 36 resting on the floor or deck of the B unit 14. Thus, the middle trailer 32 spans the gap between the units 12 and 14. The middle trailer's tandem simply rests on the floor of the B unit and is allowed to scrub back and forth as the car negotiates a curve. With this latter arrangement, the outer trailers 28A, 28B could also be 57-foot trailers. The central hitches 24 would be collapsed to accommodate 57-foot outer trailers.

Figure 2:
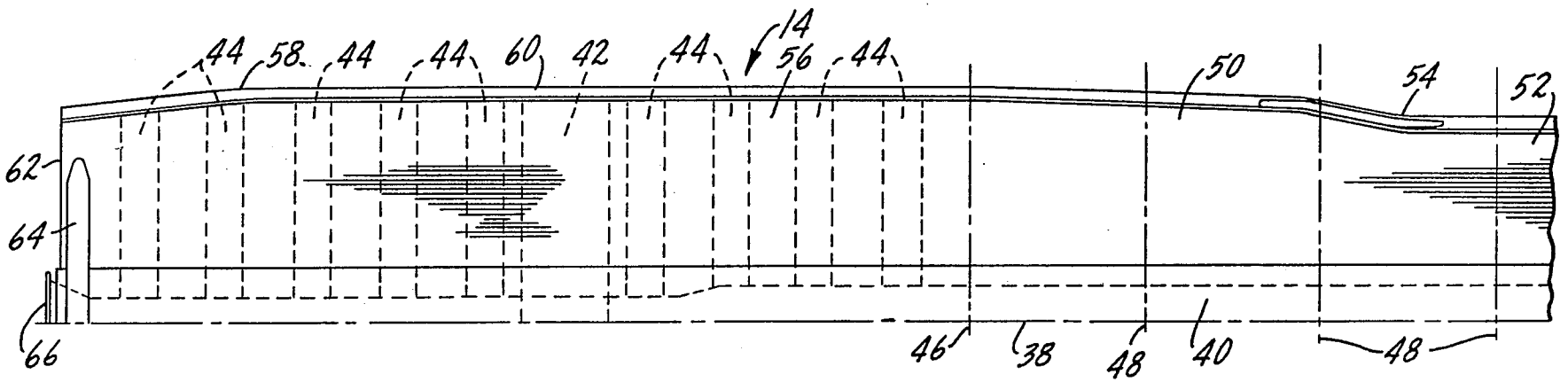
FIG. 2 is a plan view of the inner or drawbar end of the B unit, showing the widened portion of the deck.

Turning now to FIG. 2, the drawbar end of the B unit 14 is shown. Since the unit is symmetrical about its longitudinal center line 38, only half of the unit is shown. The frame of the unit includes a center sill 40 which extends the entire length of the car. A plurality of laterally-extending members are attached to the center sill. These include a bolster 42 which connects with the car truck. A plurality of support beams 44 are disposed on either side of the bolster 42. The frame further has crossbraces and cross-ties, indicated schematically by the centerlines 46 and 48.

A floor or deck 50 is supported on the framework just described. The floor has a first portion 52 having a normal or standard width of about nine and a half feet, which is sufficient to support a tandem of a trailer when the trailer is longitudinally aligned with the unit. Beginning at the point indicated at 54 and extending to the drawbar end of the B unit, the floor 50 is of an increased width and defines a second, widened portion 56. Point 54 is located approximately one-third of the platform length from the drawbar end. The widened portion 56 of the floor, with its increased width, can support a trailer's tandem even when the trailer is angled or skewed with respect to the longitudinal axis of the car. Specifically, the second, widened portion 56 at its widest point is about ten feet eight inches wide. This width is sufficient to support the tandem when its longitudinal axis is angled from about 10 degrees to about 15 degrees from the longitudinal axis of the unit 14. The significance of this widened portion of the B unit floor will become apparent in a moment. Beginning at about the point indicated at 58, the second portion 56 of the floor 50 has a decreasing width toward the drawbar end of the unit.

The edge of the floor 50 carries a side sill 60. The side sill may be an upstanding channel member welded to the floor and to the lateral support members of the frame. The drawbar end of the unit includes an end sill 62 and a reinforcement 64. A portion of the yoke for mounting the drawbar is shown at 66.

The widened portion of the floor accommodates the twisting or skewing of the spanning trailer's tandem or wheel set when the car negotiates a curve. That is, when the car rounds a curve, the longitudinal axis of the spanning trailer will no longer coincide with that of the car units. This movement of the trailer and its tandem relative to the unit on which the tandem rests causes the tandem to be diagonally disposed on the floor of the unit, relative to the longitudinal axis of the car. This increases the effective width of the tandem, which is accommodated by the widened portion of the unit on which the tandem rests. The length of the widened floor portion is sufficient to accommodate 57-foot trailers having tandems moved fully to the rear of the trailer, as well as tandems located inwardly from the end of the trailer. While a portion of the floor is flared to an additional width, this width is maintained within the required clearance specifications.

Figure 3:
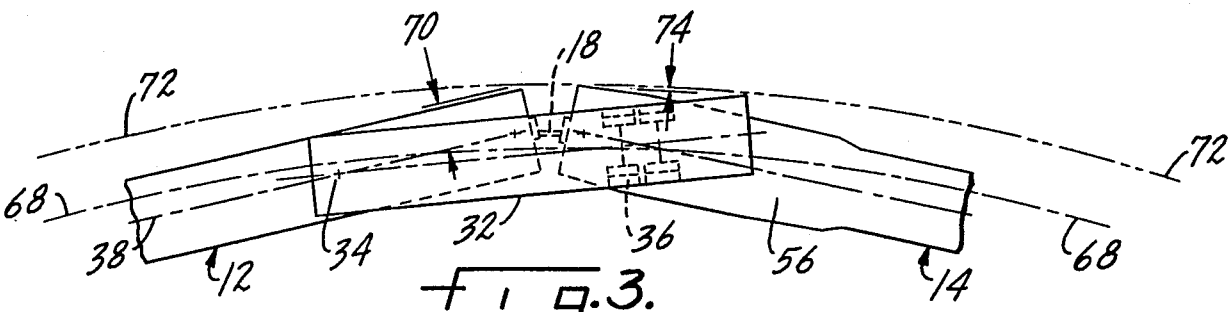
FIG. 3 is a clearance diagram showing the clearance on the outside of a curve under the maximum condition.
Figure 4:
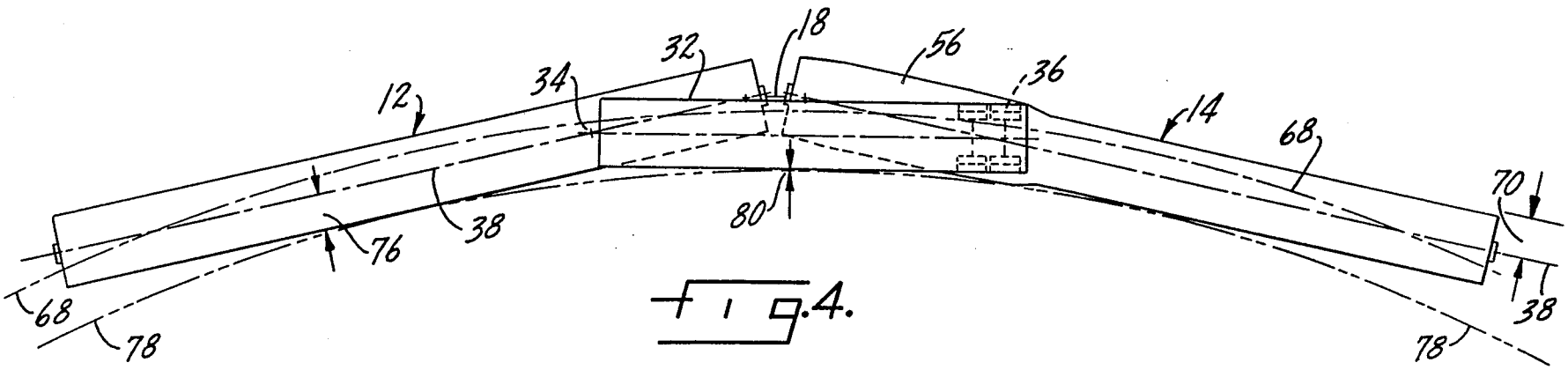
FIG. 4 is a clearance diagram showing the clearance on the inside of a curve under the maximum condition.

FIGS. 3 and 4 illustrate the geometry of a trailer spanning the units as they round a curve and how the trailer and car will meet the required clearance specifications. Specifically, FIGS. 3 and 4 show two 90-foot units connected with a 90-inch drawbar and having 66-foot truck centers. The drawbar swing is 12.33 degrees on a 215-foot radius curve.

FIG. 3 shows the clearance on an outside of a curve with a 48-foot trailer having its tandems moved forward to the so-called east coast setting. This is the maximum or extreme condition for clearance on the outside of a curve. Only the portions of the units near the drawbar ends are shown in this diagram. A 215-foot radius curve is illustrated at 68. The American Association of Railroads clearance specification known as "plate C" allows a 59-inch width from the centerline of the car to an outer edge at the end of the car. This distance is indicated at 70. An arc tangent to the plate C clearance line at the end of the car is drawn at 72. As indicated at dimension 74, there is approximately a 3⅝ inch clearance between the corner of a 48-foot trailer and the clearance line arc 72.

It will also be noted that despite the angling of the trailer 32 with respect to the unit 14, the widened portion 56 of the floor fully supports the tandem 36 of the trailer. The term fully support is given a special meaning. It means that the widened portion 56 underlies the leading and trailing edges of the tires of the tandem, as projected vertically, in addition to literally contacting and supporting the bottom edges of the tires. In other words, no portion of the tires hangs over the edge of the floor.

Turning now to FIG. 4, the clearance conditions on the inside of a curve are shown. Here, the maximum or extreme conditions are created by a 57-foot trailer with its tandem moved to the rear, i.e., the tandem is in a west coast setting. The critical plate C clearance is at the center of the car. The distance specified is 56.48 inches, as shown at dimension 76. An arc tangent to the plate C clearance line at the center of the car is shown at 78. As dimension 80 indicates, there is a one-inch clearance between the trailer 32 and the clearance line arc 78. Thus, the car loaded as shown will meet the requirements of the specification. Further, it will be noted that the flared or widened portion 56 of the B unit's floor will fully support the angled tandem 36. Note that the tandem 36 in FIG. 4 is spaced much further from the drawbar end of the unit than in the situation of FIG. 3. The length of the flared portion 56 of the floor is sufficient to accommodate the angled tandem wherever the tandem is located along the trailer's length.

Figure 5:
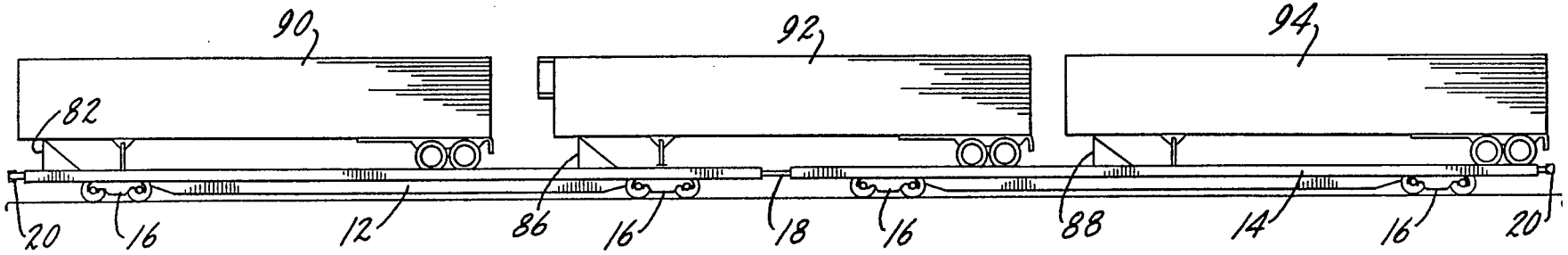
FIGS. 5 and 6 are side elevation views of an alternate embodiment of the car, which has six hitches arranged such that the car can be circus loaded.
Figure 6:
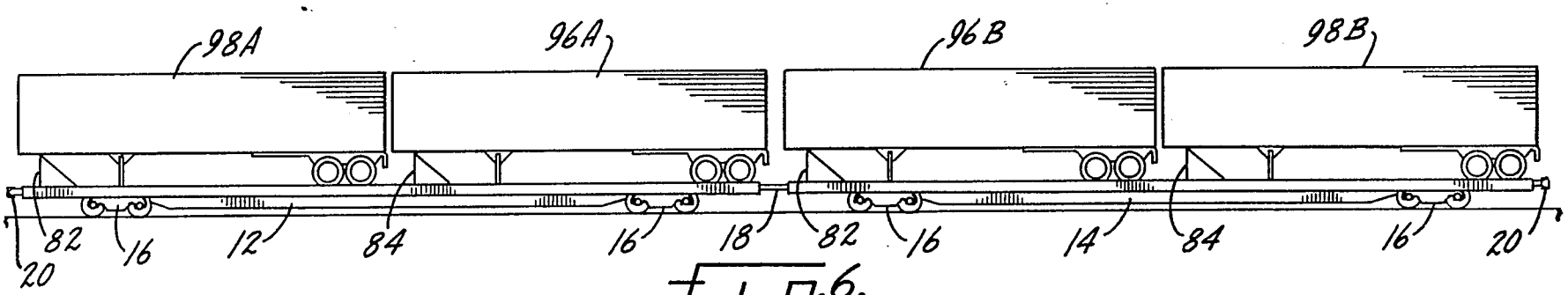

An alternate embodiment of the invention is shown in FIGS. 5 and 6. In this embodiment the car structure itself is the same as in FIG. 1 and 2, but the number and arrangement of hitches is different. Six hitches are provided, as opposed to the five on the FIG. 1 embodiment, and they are spaced to accommodate circus loading of either three long trailers or four standard trailers. Looking at FIG. 6, the car has end hitches 82 and central hitches 84 on each unit 12 and 14. It will be noted that the end hitch 84 on the B unit 14 is located at the drawbar end of the unit, as opposed to the coupler end location for the FIG. 1 embodiment. Also, the hitches on the B unit face the opposite direction from those of the FIG. 1 car so that all hitches face the same direction in the alternate car embodiment.

Looking at FIG. 5, the car of the alternate embodiment also has a span hitch 86 on the A unit 12 and an auxiliary hitch 88 on the B unit 14. The auxiliary hitch 88 is located between the central hitch 84 and the drawbar end of the B unit. FIG. 5 illustrates circus loading of three 57-foot trailers. A first trailer 90 is connected to end hitch 82 on the A unit 12. A second trailer 92 is connected to span hitch 86 on the A unit and spans the drawbar 18, with its tandem resting on the widened floor portion of the B unit. A third trailer 94 is connected to the auxiliary hitch 88 on the B unit 14. With this loading arrangement the unused central and end hitches would, of course, be collapsed.

FIG. 6 illustrates circus loading of four 45-foot trailers. With this loading arrangement the span and auxiliary hitches 86 and 88 are collapsed. Inner trailers 96A and 96B are connected to the central and end hitches of the A and B units, respectively. Similarly, outer trailers 98A and 98B are connected to the respective end and central hitches of the A and B units.

It can be seen that the car of the present invention provides the flexibility of accepting various size trailers without wasting car space. Long trailers spanning the two units are fully supported by the widened portion of the floor on the B unit.

While the preferred form of the invention has been shown and described, it will be realized that alterations or modifications may be made thereto without departing from the scope of the following claims. For example, while the car has been shown with just two platforms or units, there could be three or more platforms if desired.

We claim:

1. A railroad flat car for transporting trailers having at least one tandem, comprising first and second units each having a frame mounted at either end on pairs of trucks, the units being connected by a drawbar, one of the units having a span hitch mounted thereon and positioned such that a trailer is attachable to the span hitch with the trailer spanning the drawbar and the tandem supported on the other unit, and said other unit having a floor mounted on its frame, the floor having a first portion of a width which is not large enough to fully support the tandem of a trailer whose longitudinal axis is angled from about 10 degrees to about 15 degrees from the longitudinal axis of said other unit, and a second portion, wider than the first portion, and having a width sufficient to fully support the tandem of the spanning trailer when the longitudinal axis of said tandem is angled from about 10 degrees to about 15 degrees from the longitudinal axis of said other unit.

2. The flat car of claim 1 further comprising a plurality of hitches mounted on the units, the hitches being adapted to secure the kingpins of semi-trailers to be transported, including end hitches adjacent one of the ends of each unit and central hitches intermediate the ends of each unit.

3. The flat car of claim 2 wherein the end hitches are located adjacent the outer ends of the units.

4. The flat car of claim 2 wherein the end hitch on said one unit is located adjacent the outer end of said one unit and the end hitch on said other unit is located adjacent the drawbar end of said other unit, and further comprising an auxiliary hitch on said other unit between the central and end hitches.

5. The flat car of claim 1 further comprising a side sill attached to the floor.

6. The flat car of claim 1 wherein the first portion of the floor is about nine and a half feet wide the second portion of the floor is about ten feet eight inches wide.

7. A railroad flat car for transporting trailers having at least one tandem, comprising:

first and second units each having a frame mounted at either end on pairs of trucks;

a drawbar connecting the two units and couplers at the outer ends of the units;

a floor mounted on one of the units having a first portion at the coupler end of a width sufficient to fully support the width of the tandem only when the longitudinal axis of said tandem is substantially parallel to the longitudinal axis of said unit, the floor also having a second portion at the end adjacent the drawbar of a width greater than the first portion and sufficient to fully support the tandem when the longitudinal axis of said tandem is angled from about 10 degrees to about 15 degrees from the longitudinal axis of said unit.

8. The flat car of claim 7 further comprising a plurality of hitches mounted on the units, the hitches being adapted to secure the kingpins of trailers to be transported, including end hitches adjacent one of the ends of each unit, central hitches intermediate the ends of each unit and a span hitch on the other of the units located intermediate the central hitch of the other unit and the drawbar such that a trailer can be secured to the span hitch with its tandem resting on said second portion of the floor of said one unit.

9. The flat car of claim 8 wherein the end hitches are located adjacent the outer ends of the units.

10. The flat car of claim 8 wherein the end hitch on said other unit is located adjacent the outer end of said other unit and the end hitch on said one unit is located adjacent the drawbar end of said one unit, and further comprising an auxiliary hitch on said one unit between the central and end hitches.

11. The flat car of claim 7 wherein the first portion of the floor is about nine and a half feet wide and the second portion of the floor is about ten feet eight inches wide.

12. A railroad flat car for transporting semi-trailers, comprising:

first and second units each having a frame mounted at either end on pairs of trucks;

a drawbar connecting the adjacent ends of the two units;

a plurality of hitches mounted on the units, the hitches being adapted to secure the kingpins on semi-trailers to be transported, including end hitches adjacent one of the ends of each unit, central hitches intermediate the ends of each unit and a span hitch on one of the units located intermediate the central hitch of said one unit and the drawbar such that a semi-trailer can be secured to the span hitch with its tandem resting on the other unit.

13. The flat car of claim 12 wherein said other unit has a floor mounted thereon having a first portion at the end opposite the drawbar of a width sufficient to fully support the width of the tandem when the longitudinal axis of said tandem is parallel to the longitudinal axis of said other unit, the floor also having a second portion at the end adjacent the drawbar of a width sufficient to fully support the tandem when the longitudinal axis of said tandem is angled from about 10 degrees to about 15 degrees from the longitudinal axis of said other unit.

14. The flat car of claim 12 wherein the end hitches are located adjacent the outer ends of the units.

15. The flat car of claim 12 wherein the end hitch on said one unit is located adjacent the outer end of said one unit and the end hitch on said other unit is located adjacent the drawbar end of said other unit, and further comprising an auxiliary hitch on said other unit between the central and end hitches.

16. The flat car of claim 13 wherein the first portion of the floor is about nine and a half feet wide and the second portion of the floor is about ten feet eight inches wide.

* * * * *